United States Patent [19]

Howard

[11] 4,094,015

[45] June 13, 1978

[54] NECK ROLL FOR HELMET

[76] Inventor: Frank N. Howard, 712 Madison Ct., Apt. 254, Arlington, Tex. 76011

[21] Appl. No.: 766,392

[22] Filed: Feb. 7, 1977

[51] Int. Cl.[2] ..... A42B 3/02

[52] U.S. Cl. ..... 2/415

[58] Field of Search ..... 2/410–415, 2/2

[56] References Cited

U.S. PATENT DOCUMENTS

| | | | |
|---|---|---|---|
| 2,901,750 | 9/1959 | McMurry | 2/415 |
| 3,189,917 | 6/1965 | Sims | 2/415 |
| 3,242,500 | 3/1966 | Derr | 2/412 |
| 3,497,872 | 3/1970 | Mitchell | 2/2 |

FOREIGN PATENT DOCUMENTS

| | | | |
|---|---|---|---|
| 2,285,823 | 4/1976 | France | 2/414 |
| 2,294,659 | 7/1976 | France | 2/414 |

*Primary Examiner*—Alfred R. Guest

*Attorney, Agent, or Firm*—Allison C. Collard

[57] ABSTRACT

A neck roll of cushion material to be affixed to a helmet or similar protective device to become an integral part thereof, which neck roll stays in the proper position between the shoulders and the bottom edge of the helmet shell regardless of orientation of the head and protects the cervical spine when the head is rotated or is hyperextended or hyperflexed and from the rear edge of the helmet shell.

2 Claims, 8 Drawing Figures

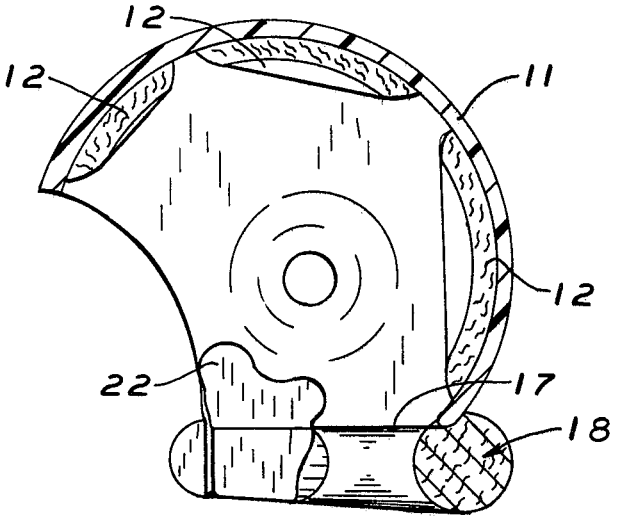
FIG. 3
FIG. 4
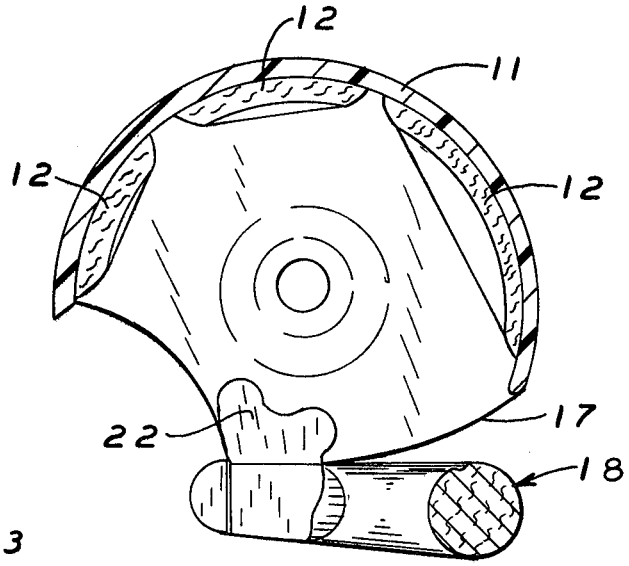
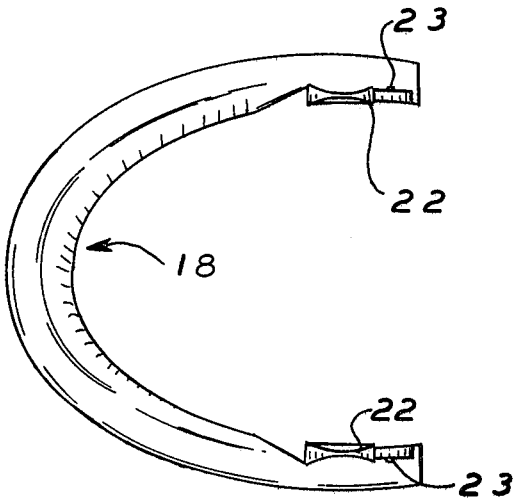
FIG. 8

NECK ROLL FOR HELMET

BACKGROUND OF THE INVENTION

This invention relates to a protective neck roll and more particularly to a neck roll of cushion material which can be affixed to a conventional football helmet or other similar protective device employed by persons engaged in body contact activities.

In body contact sports such as football, lacrosse and ice hockey the protection of the player's body from injury is of primary concern but at the same time it is highly desirable to permit the player as much freedom of movement as possible. For instance, in the game of football, the contact forces between players have called for a maximum of protection for the player but the freedom of movement of the player must still be given primary consideration. Great strides have been made in protecting the football player and in particular certain areas of the body more susceptible to injury than others. Helmets with interior padding and face masks have been developed to protect the head from injury. Shoulder pads and rib pads have been employed to protect the upper portion of the body, while hip pads and leg guards have been developed to protect the lower portions of the body. However, the area of the neck has been relatively ignored due probably to the desire for freedom of head movement, a key requirement in the game of football.

Moreover, it has been recognized that successful efforts in helmet design, face guards and helmet suspensions have contributed somewhat to the alarming increase in neck injuries as a result of the transfer of forces applied to the helmet directly onto the neck. For instance, when the conventional helmet with its face guard is struck frontally with a blow, the helmet pivots rearwardly and the sharp lower edge of the rear of the helmet strikes the back of the neck producing severe injuries and on occasion fatalities. In addition, forces applied to other areas of the helmet must be borne by the neck which in reality is a relatively fragile member. For instance, a heavy blow or force applied to the top of the helmet results in a severe compressive force on the neck often resulting in disastrous injurious results.

As forces during the game of football are generally applied to the player's helmet from any and all directions, the neck is therefore subjected to a variety of stresses including compression, flexing, extension, bending, torsion and the like.

In the prior art various types of neck guards have been developed for the purpose of protecting the neck but such devices do not become an integral part of the helmet and are not completely satisfactory in protecting the neck and spine from blows applied to the head. See for example, U.S. Pats. Nos. 3,497,872, 3,189,917, 3,514,784, 3,591,863 and 3,242,500.

SUMMARY OF THE INVENTION

It is a primary object of the invention to provide a neck roll for attachment to a helmet or similar protective device which combination limits hyperextension, lateralflexion and hyperflexion of the cervical spine and protects the posterior cervical spine from the rear edge of the helmet shell during hyperextension and from external forces, e.g., from being kicked or hit with a hand or arm.

It is a further object of the invention to provide an improved neck roll particularly adapted for use by persons engaged in body contact sports.

It is a further object to provide an improved neck roll which can be readily and easily snapped onto most conventional football helmets by simply removing the jaw pads and attaching the snap-in neck roll to the existing male jaw snaps inside the helmet.

It is a further object to provide a neck roll which is simple and economical to manufacture and is efficient and well suited for its intended purpose.

BRIEF DESCRIPTION OF THE DRAWINGS

Other objects and advantages will become apparent from the follow description which is to be taken in conjunction with the accompanying drawings, in which:

FIG. 3 is a sectional view along the line 3—3 of FIG. 2;

FIG. 4 is a sectional view similar to that of FIG. 3 showing the back of the neck roll separated from the helmet;

FIG. 8 is a top plan view of the said neck roll.

DESCRIPTION OF THE PREFERRED EMBODIMENT

Figure 1:
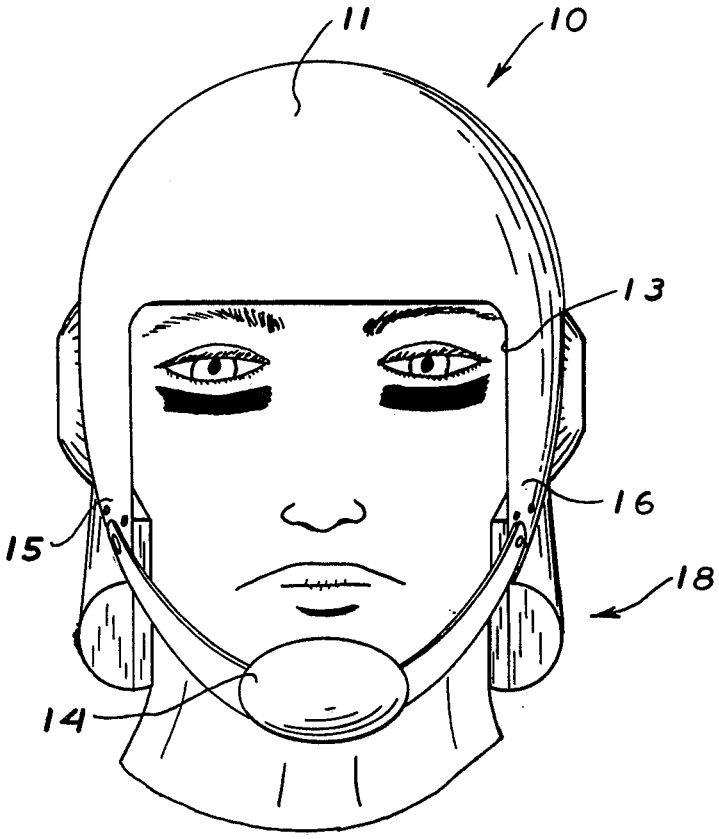
FIG. 1 is a front elevational view of the protective helmet with the snap-in neck roll of the present invention.

Referring to the drawings there is shown in FIG. 1 the head of a player wearing a football helmet to which has been affixed the neck roll of the present invention. The helmet shown is of conventional design and construction, but other similar type helmets may be used with the neck roll described and claimed herein. As will be explained herein the neck roll becomes an integral part of the helmet and cooperates therewith during participation in the game of football by the player, so as to protect the neck, spine and associated areas from the severe stresses such as blows to the helmet and helmet face commonly encountered during the game.

Figure 2:
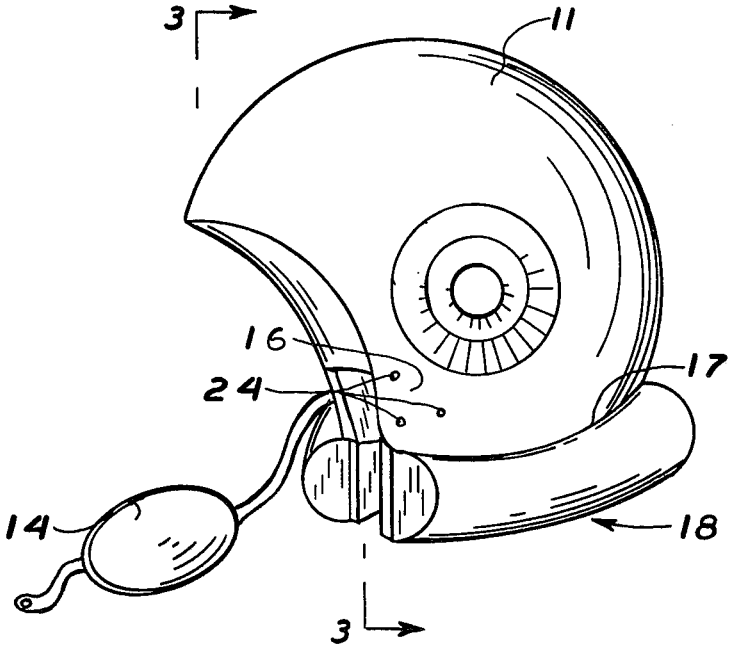
FIG. 2 is a side elevational view of the helmet and neck roll of FIG. 1.
Figure 5:
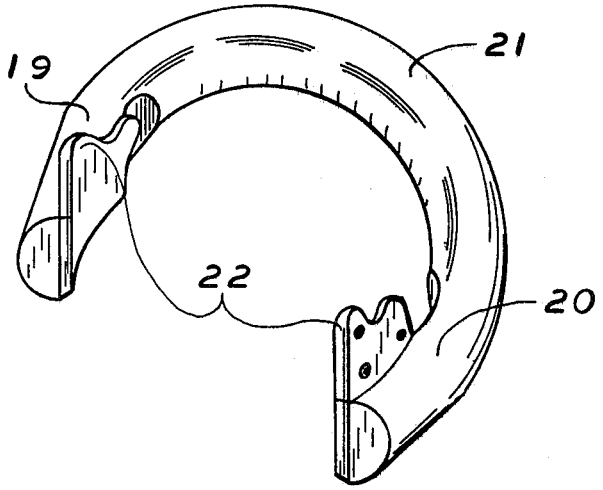
FIG. 5 is a perspective view of the said neck roll.
Figure 6:
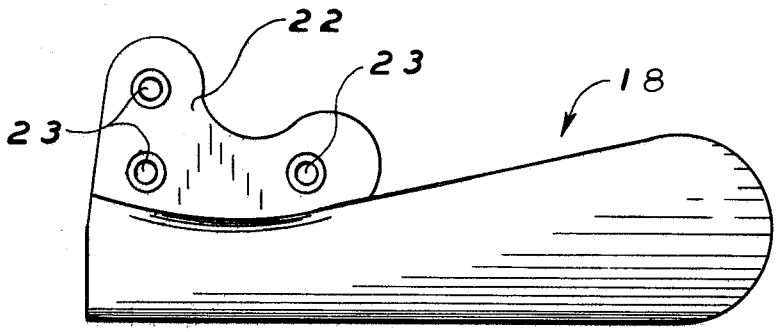
FIG. 6 is a side elevational view of the said neck roll.
Figure 7:
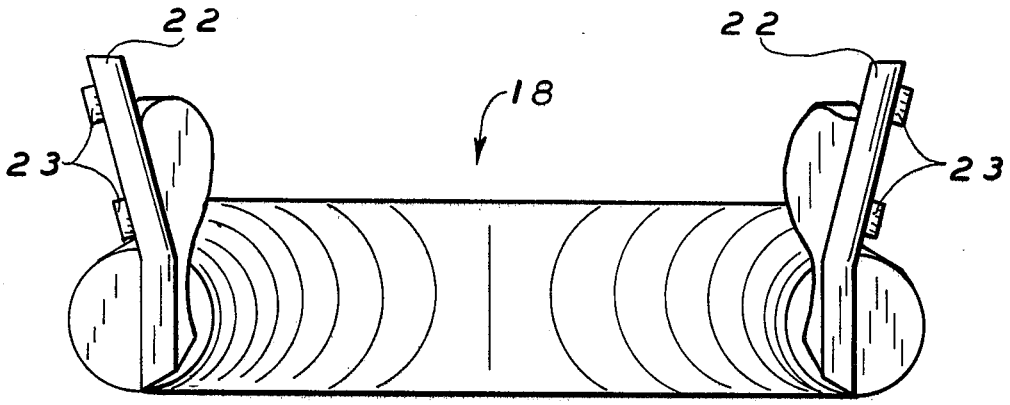
FIG. 7 is a front elevational view of the said neck roll.

The helmet 10 is made up of a shell 11 constructed of any suitable rigid material such as plastic or the like which conforms generally to the shape of the head. The interior of the helmet is provided with suitable padding 12 such as foam rubber to protect the player's head when force is applied to the helmet (FIGS. 3 and 4). The helmet is provided with a frontal opening 13 for the player's face across which can be positioned a face guard not shown. The guard can be secured on opposite sides of the helmet across the face opening 13 by means such as rivets. A chin strap 14 is secured at each end to helmet portions 15, 16 which lie over the player's ears and the helmet extends downwardly to a position adjacent the level of the chin to form a bottom edge 17 extending completely around the helmet and terminating adjacent each side of the helmet face opening (FIG. 2).

The neck roll 18 (FIGS. 5–8) comprises a substantially U-shaped member adapted to straddle the player's neck, including a pair of leg sections 19 and 20, engageable with the upper portions of the player's shoulders adjacent the player's neck, and an intermediate connection section 21 disposable adjacent the back of the player's neck. The neck roll may be formed from resilient material, such as foam rubber, in the form of an inflatable device, or in the form of a shell the interior of which is filled with suitable material or stuffing. Such shell may be of any suitable material such as leather, plastic or the like. The outer surface may be provided with a soft and smooth impervious coating such as vinyl or latex which will prevent chafing or irritation to the skin, and yet will not absorb perspiration.

The neck roll is generally in the form of a tube with an upper planar surface on which the bottom edge of the helmet shell will sit when the roll is attached to the helmet. The ends of the leg sections 19 and 20 of the neck roll are provided with strips 22 which project upward from the roll and provide a means to secure the roll to the helmet. Since the strips project into the helmet, they are preferably made of the same material as the roll to provide a cushion against the face on the inside of the helmet (FIG. 3). Such strips have snap fasteners 23 which engage a cooperating fastener 24 on each inner surface of the helmet portions 15, 16. In most conventional football helmets there are male jaw pad snaps inside the helmet for attaching jaw pads to the helmet. In such helmets the jaw pads can be removed and the neck roll can be snapped into the helmet using the male jaw pad snaps inside the helmet.

When the neck roll is attached to the helmet it stays in the proper position regardless of orientation of the head. Injury occurs most often when the head is rotated and the head is either hyperextended or hyperflexed. The roll of the present invention limits hyperextension, lateralflexion and hyperflexion of the cervical spine. Furthermore the posterior cervical spine is always protected from the rear edge of the helmet during hyperextension and from external forces, such as a kick or a hit with a hand or arm. It will thus be evident that the present invention provides greater protection than is found in neck protectors or collars which are not affixed to the helmet and merely rest on the shoulders of the player. Furthermore, the neck roll of the present invention will not interfere with any of the head or body movements of the player or with other conventional protective equipment such as helmets and shoulder pads.

Thus, among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. A neck roll adapted for attachment to a helmet of the type worn by players in contact sports having a face opening and a bottom edge comprising:

a U-shaped tubular member for encircling the neck of a wearer, said member being formed of a resilient material to serve as a cushion around the neck;

means at the forward ends of the tubular member projecting upward from said member, said projecting means being provided with fastening means for demountably securing said member to the helmet on each side of the face opening, said projecting means at the forward ends of the tubular member comprising resilient strips adapted to lie against the inner surface of the helmet on each side of the face opening;

said member being sized and positioned to lie around the bottom edge of the helmet and make firm contact therewith, said tubular member being provided with an upper planar surface engageable in abutting relationship with the bottom edge of the helmet, with the lower surfaces of said tubular member being engageable with portions of the users shoulder adjacent to the neck and the back of the user's neck;

whereby the neck roll will be free to move with the helmet and head and will protect the neck, spine and associated areas from injury.

2. The neck roll of claim 1 wherein the tubular member is formed of foam rubber.

* * * * *